US011319821B2

(12) United States Patent
Pela et al.

(10) Patent No.: US 11,319,821 B2
(45) Date of Patent: May 3, 2022

(54) LOCKING SPACER ASSEMBLY, CORRESPONDING BLADE ASSEMBLY, METHOD FOR INSTALLING A LOCKING SPACER

(71) Applicant: Siemens Energy Global GmbH & Co. KG, Munich (DE)

(72) Inventors: Adam C. Pela, Jupiter, FL (US); Krishna C. Veluru, Jupiter, FL (US); Kenneth W. Giersdorf, Port Saint Lucie, FL (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 17/040,280

(22) PCT Filed: Apr. 18, 2018

(86) PCT No.: PCT/US2018/028141
§ 371 (c)(1),
(2) Date: Sep. 22, 2020

(87) PCT Pub. No.: WO2019/203819
PCT Pub. Date: Oct. 24, 2019

(65) Prior Publication Data
US 2021/0003022 A1 Jan. 7, 2021

(51) Int. Cl.
*F01D 5/32* (2006.01)

(52) U.S. Cl.
CPC ..... *F01D 5/32* (2013.01)

(58) Field of Classification Search
CPC ..... F01D 5/32
See application file for complete search history.

(56) References Cited

U.S. PATENT DOCUMENTS 2,421,855 A * 6/1947 Soderberg ..... F01D 5/3038 416/217
3,721,506 A * 3/1973 Anderson ..... F01D 5/32 416/215
7,114,927 B2 * 10/2006 Bachofner ..... F01D 5/3038 416/213 R (Continued)

FOREIGN PATENT DOCUMENTS

GB 639320 A 6/1950
GB 659592 A 10/1951

OTHER PUBLICATIONS

PCT International Search Report and Written Opinion of International Searching Authority dated Feb. 5, 2019 corresponding to PCT International Application No. PCT/US2018/028141 filed Apr. 18, 2018.

*Primary Examiner* — Courtney D Heinle
*Assistant Examiner* — Ryan C Clark

(57) ABSTRACT

A locking spacer assembly for filling a final spacer slot in a disk groove between platforms of adjacent blades of a blade assembly in an industrial gas turbine engine is presented. The locking spacer assembly includes a first side piece, a second side piece, a mid piece and a bolt. The bolt is disposed into the mid piece to position the mid piece in a radial position in an assembled state. The mid piece contacts the first side piece and the second side piece in the assembled state to prevent axial movements of the first and second side pieces in the disk groove. The bolt prevents a radial movement of the mid piece.

17 Claims, 4 Drawing Sheets

(56) References Cited

U.S. PATENT DOCUMENTS

| | | | | |
|---|---|---|---|---|
| 7,192,256 | B2 * | 3/2007 | Bachofner | F01D 5/32 416/212 A |
| 8,157,531 | B2 * | 4/2012 | Krutzfeldt | F01D 5/32 416/220 R |
| 8,523,529 | B2 * | 9/2013 | Brittingham | F01D 5/32 416/215 |
| 9,341,071 | B2 * | 5/2016 | Healy | F01D 5/303 |
| 9,512,732 | B2 * | 12/2016 | Potter | F01D 11/008 |
| 10,519,970 | B2 * | 12/2019 | Montgomery | F01D 5/32 |
| 2002/0127105 | A1 | 9/2002 | Bachofner et al. | |
| 2006/0222502 | A1 * | 10/2006 | Hansen | F01D 5/3038 416/220 R |
| 2015/0101348 | A1 * | 4/2015 | Hansen | F01D 5/303 60/805 |
| 2018/0023402 | A1 * | 1/2018 | Sieber | F01D 5/303 416/244 A |

* cited by examiner

LOCKING SPACER ASSEMBLY, CORRESPONDING BLADE ASSEMBLY, METHOD FOR INSTALLING A LOCKING SPACER

TECHNICAL FIELD

This invention relates generally to a locking spacer assembly, in particular, a locking spacer assembly configured to fill a final spacer slot in a disk groove between platforms of adjacent blades of a blade assembly in an industrial gas turbine engine.

DESCRIPTION OF RELATED ART

An industrial gas turbine engine typically includes a compressor for compressing air, a combustor for mixing the compressed air with fuel and igniting the mixture, a turbine section for producing mechanical power, and a generator for converting the mechanical power to an electrical power. The compressor and the turbine section include a plurality of blades that are attached on a rotor. The blades are arranged in rows axially spaced apart along the rotor and circumferentially attached to a periphery of a rotor disk.

FIG. 1 illustrates a schematic perspective view of a portion of a blade assembly 100. As illustrated in FIG. 1, the blade assembly 100 includes a plurality of blades 120 that are attached to a rotor disk 140. Each blade 120 includes a platform 122 and a root 124 extending radially inward from the platform 122. During blade assembly, the blades 120 may be installed to the rotor disk 140 by inserting the roots 124 of the blades 120 into a disk groove 142 one at a time. The blades 120 then may be rotated until the roots 124 of the blade 120 engage the disk groove 142. Once all of the blades 120 are installed into the rotor disk 140, a final spacer slot 144 is remained in the disk groove 142 between the platforms 122 of adjacent blades 120. The final spacer slot 144 may not be filled with the blade 120 because there is not sufficient space for insertion and rotation. A locking spacer assembly is typically inserted into the final spacer slot 144 to lock the blades 120 to the rotor disk 140.

A conventional locking spacer assembly typically includes a plurality of pieces, such as side pieces, middle piece, bolt and nut. The conventional locking spacer assembly may experience uncertainties during assembly. For example, the conventional locking spacer assembly may require the bolt to carry a centrifugal load of the locking spacer components. Such arrangement may create undesirable failure mode and small safety margin. Additionally, manufacture cost of the conventional locking spacer assembly may be high due to geometric complexity and numbers of the components of the locking spacer assembly. There is a need to provide a simple, reliable and low cost locking spacer assembly.

SUMMARY OF INVENTION

Briefly described, aspects of the present invention relate to a locking spacer assembly, in particular, a locking spacer assembly configured to fill a final spacer slot in a disk groove between platforms of adjacent blades of a blade assembly in an industrial gas turbine engine.

According to an aspect, a locking spacer assembly configured to fill a final spacer slot in a disk groove between platforms of adjacent blades of a blade assembly is presented. The locking spacer assembly comprises a first side piece. The locking spacer assembly comprises a second side piece. The locking spacer assembly comprises a mid piece configured to be disposed between an inner surface of the first side piece and an inner surface of the second side piece. The locking spacer assembly comprises a bolt configured to be disposed into the mid piece. The bolt is configured to position the mid piece in a radial position in an assembled state. The mid piece is configured to contact the first side piece and the second side piece in the assembled state to prevent an axial movement of the first side piece and an axial movement of the second side piece.

According to an aspect, a blade assembly is presented. The blade assembly comprises a rotor disk comprising a disk groove. The blade assembly comprises a plurality of blades inserted in the disk groove. Each of the blades comprises a platform. A final spacer slot is formed in the disk groove between platforms of adjacent blades. The blade assembly comprises a locking spacer assembly configured to fill the final spacer slot. The locking spacer assembly comprises a first side piece. The locking spacer assembly comprises a second side piece. The locking spacer assembly comprises a mid piece configured to be disposed between the inner surface of the first side piece and the inner surface of the second side piece. The locking spacer assembly comprises a bolt configured to be disposed into the mid piece. The bolt is configured to position the mid piece in a radial position in an assembled state. The mid piece is configured to contact the first side piece and the second side piece in the assembled state to prevent an axial movement of the first side piece and an axial movement of the second side piece.

According to an aspect, a method for installing a locking spacer assembly into a final spacer slot in a disk groove between platforms of adjacent blades of a blade assembly is presented. The locking spacer assembly comprises a first side piece, a second side piece, a mid piece and a bolt. The method comprises disposing the bolt into the mid piece. The method comprises placing the mid piece and the bolt disposed within the mid piece into the disk groove. The method comprises placing the first side piece and the second side piece into the disk groove one after another such that the mid piece is disposed between an inner surface of the first side piece and an inner surface of the second side piece. The method comprises positioning the mid piece in a radial position in an assembled state by the bolt such that the mid piece contacts the first side piece and the second side piece in the assembled state.

Various aspects and embodiments of the application as described above and hereinafter may not only be used in the combinations explicitly described, but also in other combinations. Modifications will occur to the skilled person upon reading and understanding of the description.

DETAILED DESCRIPTION OF INVENTION

Exemplary embodiments of the application are explained in further detail with respect to the accompanying drawings. In the drawings.

To facilitate understanding, identical reference numerals have been used, where possible, to designate identical elements that are common to the figures.

DETAILED DESCRIPTION OF INVENTION

A detailed description related to aspects of the present invention is described hereafter with respect to the accompanying figures.

Figure 1:
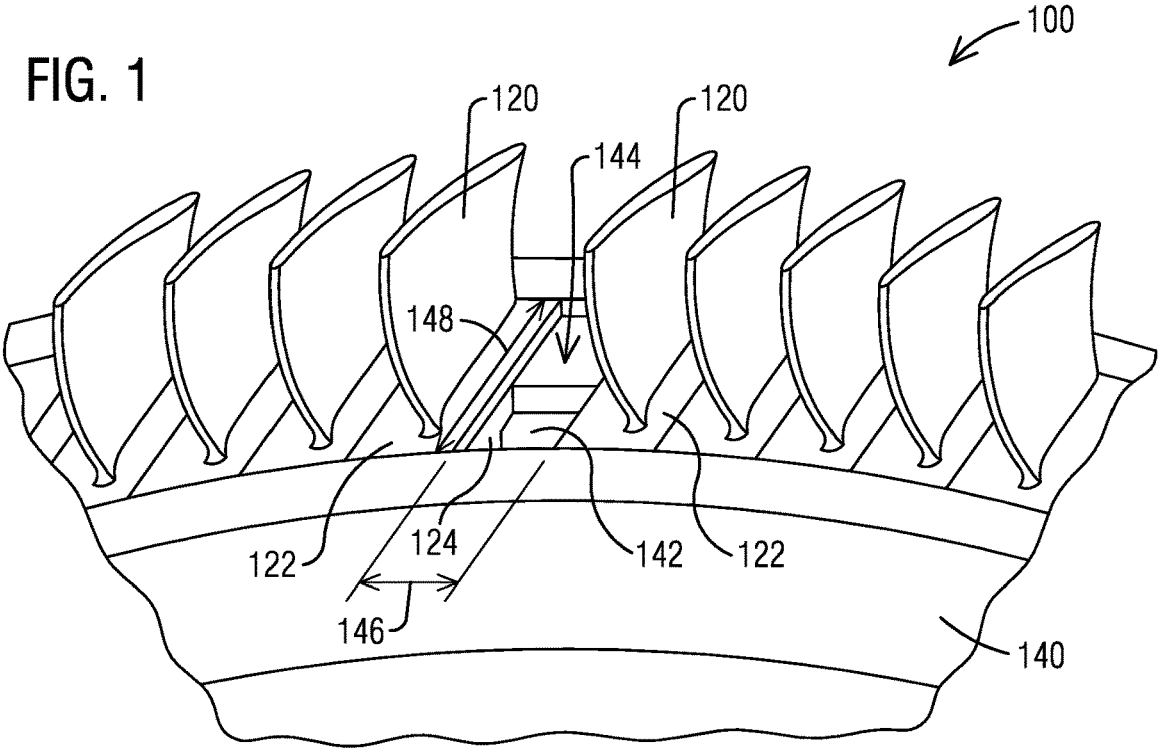
FIG. 1 illustrates a schematic perspective view of a portion of a blade assembly showing a final spacer slot, wherein an embodiment of the inventive locking spacer assembly may be incorporated.

FIG. 1 illustrates a schematic perspective view of a portion of a blade assembly 100 showing a final spacer slot 144 in a disk groove 142 between platforms 122 of adjacent blades 120. The final spacer slot 144 may have a circumferential width 146 and an axial length 148. The blade assembly 100 may be a compressor blade assembly or a turbine blade assembly. The final spacer slot 144 may be filled by inventive embodiments of a locking spacer assembly 200 as shown in FIGS. 2-9, which are described in more detail below. The locking spacer assembly 200 may be installed into the final spacer slot 144 in the disk groove 142 during assembly of the blades 120 to the rotor disk 140. The locking spacer assembly 200 may be removed from the final spacer slot 144 in the disk groove 142 during disassembly of the blades 120 from the rotor disk 140.

Figure 2:
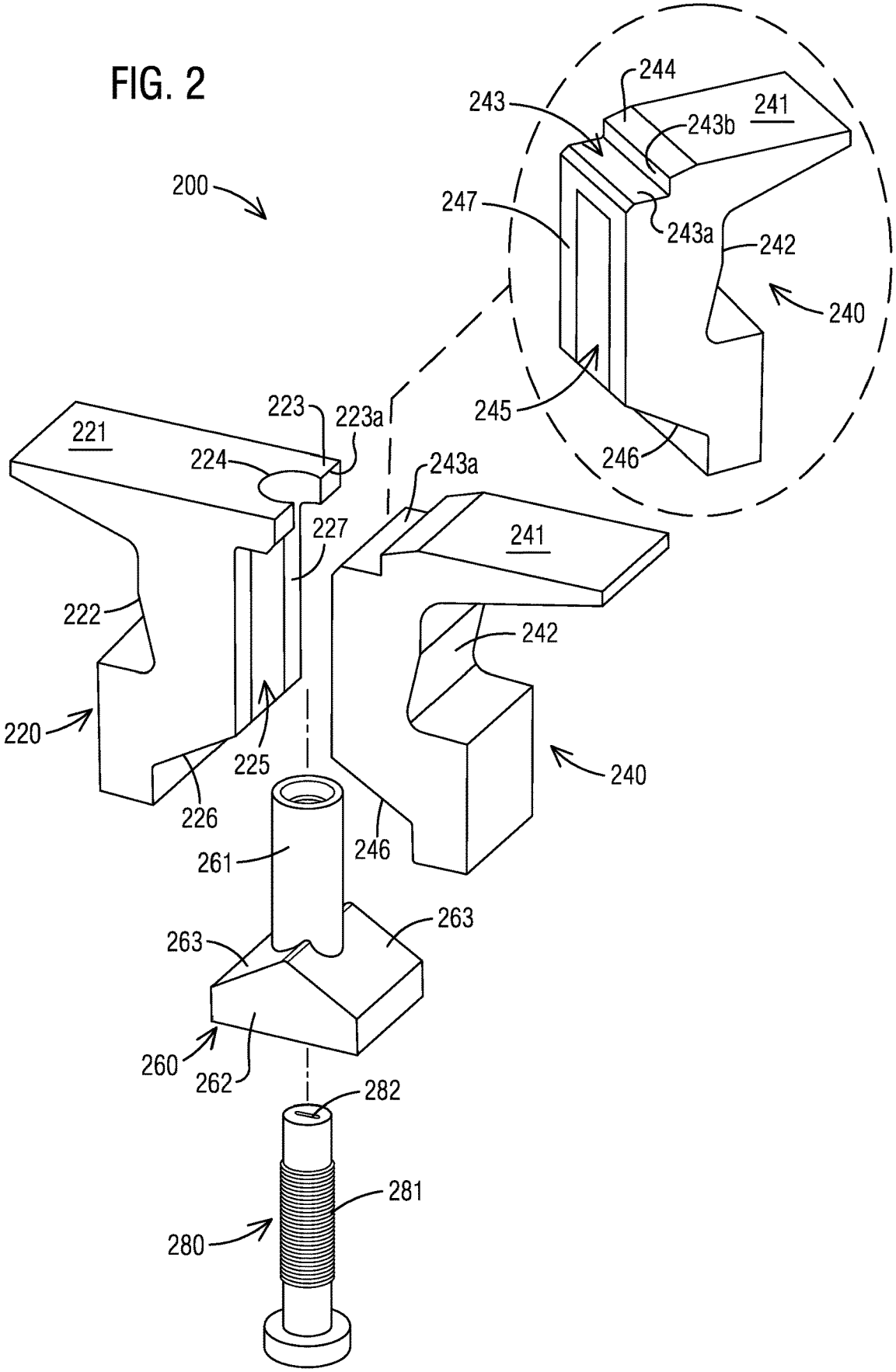
FIG. 2 illustrates a schematic perspective exploded view of a locking spacer assembly according to an embodiment of the invention.

FIG. 2 illustrates a schematic exploded perspective view of a locking spacer assembly 200 according to an embodiment of the invention. With reference to FIG. 2, the locking spacer assembly 200 may include a first side piece 220, a second side piece 240, a mid piece 260, and a bolt 280. The first side piece 220 and the second side piece 240 may have a general C-shape. The first side piece 220 may include a top surface 221, an outer surface 222, a bottom surface 226 and an inner surface 227. The second side piece 240 may include a top surface 241, an outer surface 242, a bottom surface 246 and an inner surface 247. The bolt 280 may be disposed into the mid piece 260 from bottom. The mid piece 260 and the bolt 280 may be disposed between the inner surface 227 of the first side piece 220 and the inner surface 247 of the second side piece 240. The outer surface 222 of the first side piece 220 and the outer surface 242 of the second side piece 240 may have a profile that is configured to mate with a profile of a first side inner surface 143*a* of a disk groove 142 and a profile of a second side inner surface 143*b* of the disk groove 142 such that the outer surface 222 of the first side piece 220 may contact the first side inner surface 143*a* of the disk groove 142 and the outer surface 242 of the second side piece 240 may contact the second side inner surface 143*b* of the disk groove 142 after installed into the disk groove 142, as shown in FIGS. 4-9.

The first side piece 220 may have a tab 223. The tab 223 extends from the top surface 221 and protrudes axially outwardly from the inner surface 227 of the first side piece 220. The tab 223 may have a cutout 224. The cutout 224 has an opening at an axial end 223*a* of the tab 223. An axial length of the cutout 224 may be equal to or less than an axial length of the tab 223. The cutout 224 may be positioned circumferentially at a center of the tab 223. The cutout 224 may have a circular shape. The first side piece 220 may have a circular groove 225. The circular groove 225 is disposed below the tab 223 and extends radially downwardly in the inner surface 227 of the first side piece 220. Radius of the circular groove 225 may be larger than a radius of the cutout 224. Bottom of the circular groove 225 is connected to the bottom surface 226 of the first side piece 220. The bottom surface 226 may be a horizontal surface. The bottom surface 226 may be a sloped surface. According to an exemplary embodiment shown in FIGS. 2-9, the bottom surface 226 is a sloped surface. The circular groove 225 and the bottom surface 226 of the first side piece 220 are configured to receive the mid piece 260 for easy assembling the locking spacer assembly 200.

For illustration purpose, a different perspective view of the second side piece 240 is also shown in FIG. 2. With reference to FIG. 2, the second side piece 240 may have a recess 243. The recess 243 is formed at an edge of the top surface 241 and the inner surface 247 of the second side piece 240. The recess 243 may have a general L-shape having a horizontal surface 243*a* and a vertical surface 243*b*. The recess 243 is configured to receive the tab 223 of the first side piece 220 for easy assembling the locking spacer assembly 200. A sloped surface 244 may be disposed from the top surface 241 downwardly to the vertical surface 243*b*. The sloped surface 244 is designed for avoiding flow separation and for improving aerodynamic performance during engine operation. The second side piece 240 may have a circular groove 245. The circular groove 245 is disposed below the recess 243 and extends radially downwardly in the inner surface 247 of the second side piece 240. Radius of the circular groove 245 of the second side piece 240 may be the same as the radius of the circular groove 225 of the first side piece 220. Bottom of the circular groove 245 is connected to the bottom surface 246 of the second side piece 240. The bottom surface 246 may be a horizontal surface. The bottom surface 246 may be a sloped surface. According to an exemplary embodiment shown in FIGS. 2-9, the bottom surface 246 is a sloped surface. The circular groove 245 and the bottom surface 246 of the second side piece 240 are configured to receive the mid piece 260 for easy assembling the locking spacer assembly 200.

The mid piece 260 may include a hollow cylindrical body 261 extending in a radial direction. The hollow cylindrical body 261 has a threaded inner surface. The mid piece 260 may include a base 262. The hollow cylindrical body 261 radially penetrates through the base 262 and radially extends upwardly from base 262. The hollow cylindrical body 261 may be disposed at a center of the base 262. The hollow cylindrical body 261 is configured to be disposed into the circular groove 225 of the first side piece 220 and the circular groove 245 of the second side piece 240 in an assembled state. The base 262 has two top surfaces 263 axially extending out from lower end of the hollow cylindrical body 261. The base 262 is configured to have a geometric shape such that the two top surfaces 263 of the base 262 align with the bottom surface 226 of the first side piece 220 and the bottom surface 246 of the second side piece 240 respectively. According to an exemplary embodiment shown in FIGS. 2-9, the base 262 has a general dovetail shape. The top surfaces 263 are tapered upwardly from bottom of the base 262. During assemble, the mid piece 260 is positioned in a radial position such that the mid piece 260 contact the first side piece 220 and the second side piece 260 in the assembled state. The mid piece 260 may prevent an axial movement of the first side piece 220 and an axial movement of the second side piece 240 in the assembled state. Particularly, the top surfaces 263 of the mid piece 260 contact the bottom surface 226 of the first side piece 220 and the bottom surface 246 of the second side piece 240 respectively in the assembled state. Such arrangement may form an interlock between the mid piece 260 and the first side piece 220 and the second side piece 240 for preventing axial movements of the first side piece 220 and the second side piece 240 in the assemble state.

A bolt 280 may be disposed into the mid piece 260. The bolt 280 may have rolled threads 281. Profile of the threads 281 is designed to increase fatigue strength of the bolt 280. The threads 281 of the bolt 280 is engaged with the threaded inner surface of the hollow cylindrical body 261 of the mid piece 260. The bolt 280 positions the mid piece 260 in the radial position in the assembled state. The bolt 280 may be rotated within the hollow cylindrical body 261 to move the mid piece 260 to the radial position during assembly. The bolt 280 may maintain the mid piece 260 in the radial position in the assembled state. The bolt 280 may have a recess 282 disposed on top surface of the bolt 280. The recess 282 may be engaged with a tool (not shown) for rotating the bolt 280 during assembly.

Figure 3:
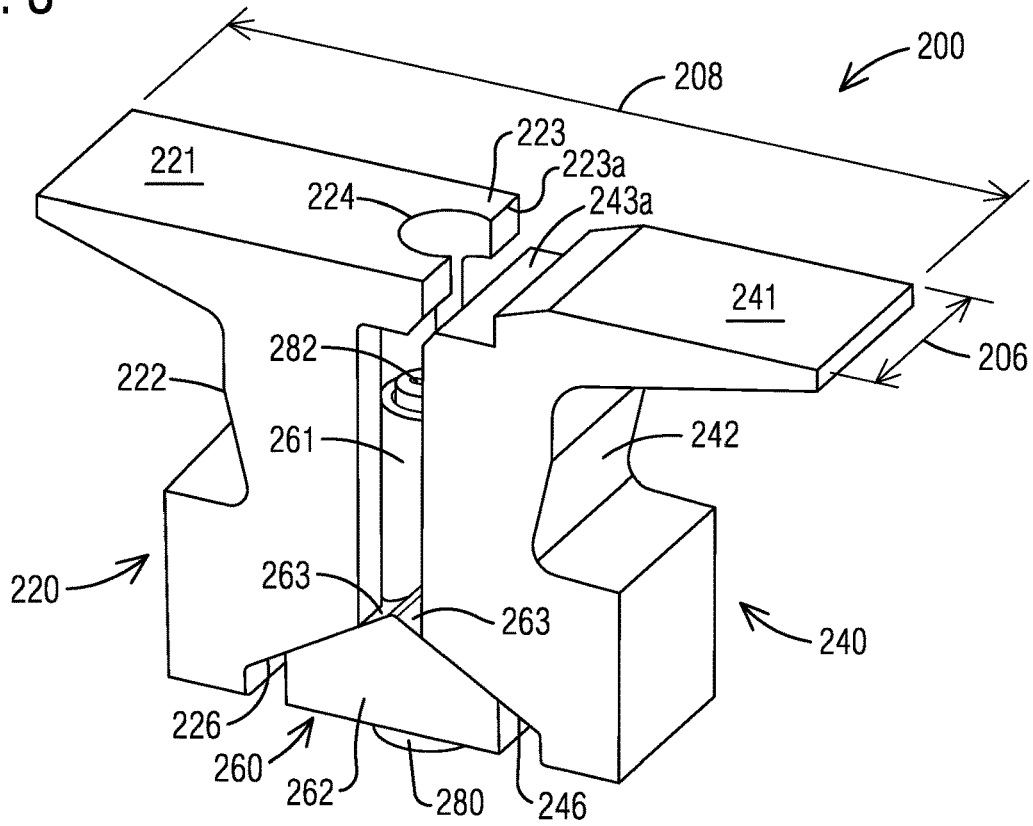
FIG. 3 illustrates a schematic perspective assembled perspective view of a locking spacer assembly according to an embodiment of the invention.

FIG. 3 illustrates a schematic assembled perspective view of the locking spacer assembly 200 as shown in FIG. 2. With reference to FIG. 3, the tab 223 of the first side piece 220 extends axially toward the recess 243 of the second side piece 240 in the assembled state. The axial end 223*a* of the tab 223 may overlap the horizontal surface 243*a* of the recess 243 in the assembled state for avoiding leakage flow and for aerodynamic stability during engine operation. For example, the axial end 223*a* of the tab 223 may overlap the horizontal surface 243*a* by 1-2 mm, or by any dimensions for optimum design considerations. The bolt 280 is threaded into the mid piece 260. The mid piece 260 and the threaded bolt 260 within the mid piece 260 are disposed between the first side piece 220 and the second side piece 240. The cutout 224 of the first side piece 220 is designed for an easy tool access to the recess 282 to tight and loose the bolt 280 during assembly. The mid piece 260 may be moved to the radial position by rotating the bolt 280 in the hollow cylindrical body 261 of the mid piece 260. According to an exemplary embodiment shown in FIG. 3, the mid piece 260 may be lifted to the radial position by rotating the bolt 280 in the hollow cylindrical body 261 to extend out the base 262 of the mid piece 260. The top surfaces 263 of the base 262 of the mid piece 260 interlock with the bottom surface 226 of the first side piece 220 and the bottom surface 246 of the second side piece 240 respectively after lifting the mid piece 260 to the radial position. Such arrangement prevents an axial movement of the first side piece 220 and an axial movement of the second side piece 240 during engine operation. The hollow cylindrical body 261 of the mid piece 260 is disposed into the circular groove 225 of the first side piece 220 and into the circular groove 245 of the second side piece 240. Height of the hollow cylindrical body 261 is equal to or less than height of the circular groove 225 of the first side piece 220 and height of the circular groove 245 of the second side piece 240 after lifting the mid piece 260. The mid piece 260 is lightweight so that only small loads are produced onto the first side piece 220 and the second side piece 240. The bolt 280 prevents a radial movement of the mid piece 260. The locking spacer assembly 200 has a circumferential width 206 and an axial length 208 after assembly. The circumferential width 206 and the axial length 208 correspond to a circumferential width 146 and an axial length 148 of a final spacer slot 144 in a disk groove 142, as shown in FIG. 1.

Figure 4:
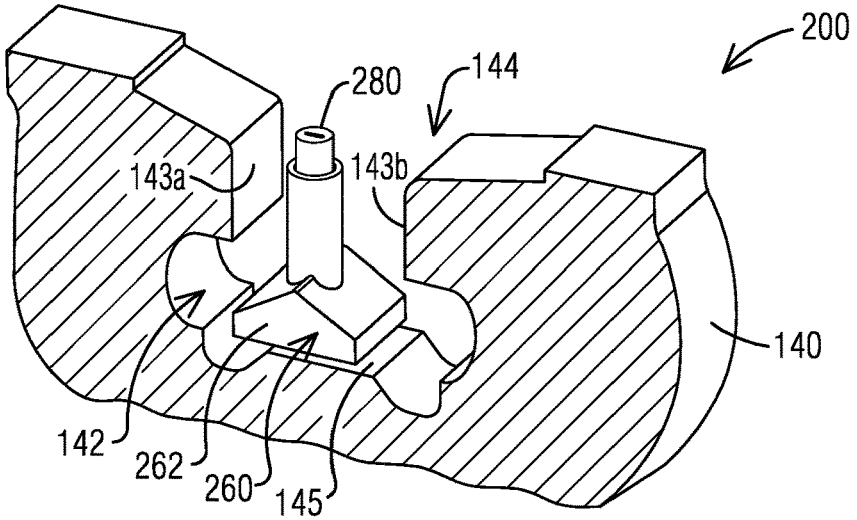
FIGS. 4-9 illustrate schematic sequential assembly perspective views of a locking spacer assembly according to an embodiment of the invention.

FIGS. 4-9 illustrate schematic sequential assembly cross section perspective views of a locking spacer assembly 200 according to an embodiment of the invention. With reference to FIG. 4, the bolt 280 is firstly threaded into the mid piece 260. The mid piece 260 and the threaded bolt 280 inside the mid piece 260 may then be placed into the final spacer slot 144 and into the disk groove 142 of the rotor disk 140. The base 262 of the mid piece 260 rests on a base surface 145 of the disk groove 142. The first side piece 220 and the second side piece 240 may then be placed into the disk groove 142 one after another such that the mid piece 260 is disposed between the inner surface 227 of the first side piece 220 and the inner surface 247 of the second side piece 240. According to an exemplary embodiment shown in FIGS. 4-9, the second side piece 240 having the recess 243 is placed into the disk groove 142 firstly. The first side piece 220 having the tab 223 is placed into the disk groove 142 secondly. It is understood that the first side piece 220 may be placed into the disk groove 142 firstly and the second side piece 240 may be placed into the disk groove 142 secondly.

Figure 5:
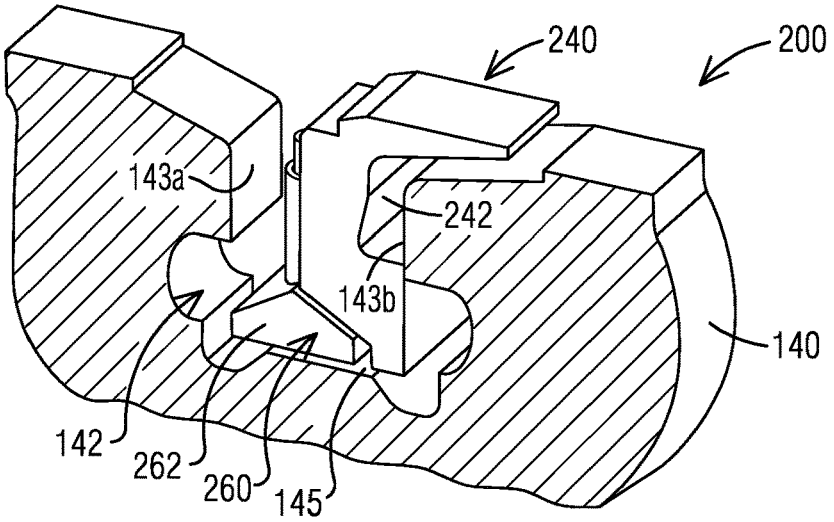

With reference to FIG. 5, the second side piece 240 having the recess 243 may then be placed into the disk groove 142 of the rotor disk 140 between the mid piece 260 and the second side inner surface 143*b* of the disk groove 142. The mid piece 260 may be moved axially toward the first side inner surface 143*a* to provide adequate axial space for the second side piece 240 to be placed into the disk groove 142.

Figure 6:
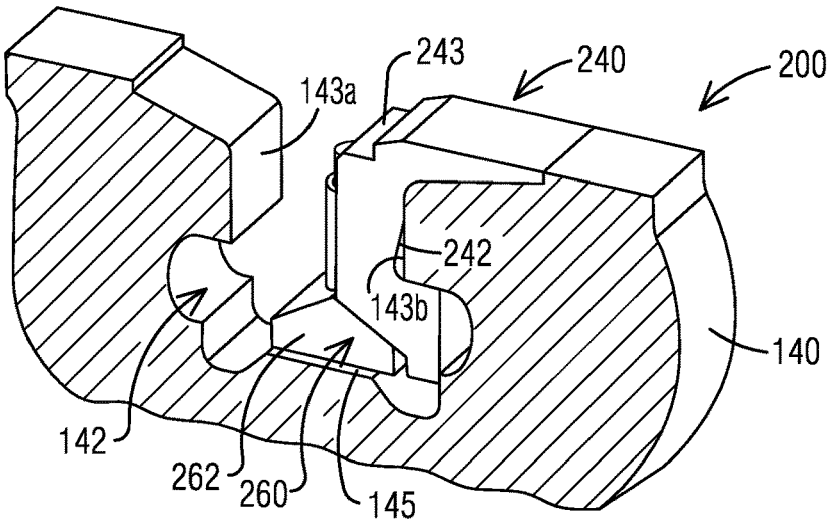

With reference to FIG. 6, the second side piece 240 may then be moved axially toward the second side inner surface 143*b* such that the outer surface 242 of the second side piece 240 contacts the second side inner surface 143*b* of the disk groove 142. The mid piece 260 may be moved in the same axial direction with the second side piece 240 to provide adequate axial space for the first side piece 220 to be placed into the disk groove 142 in the next step.

Figure 7:
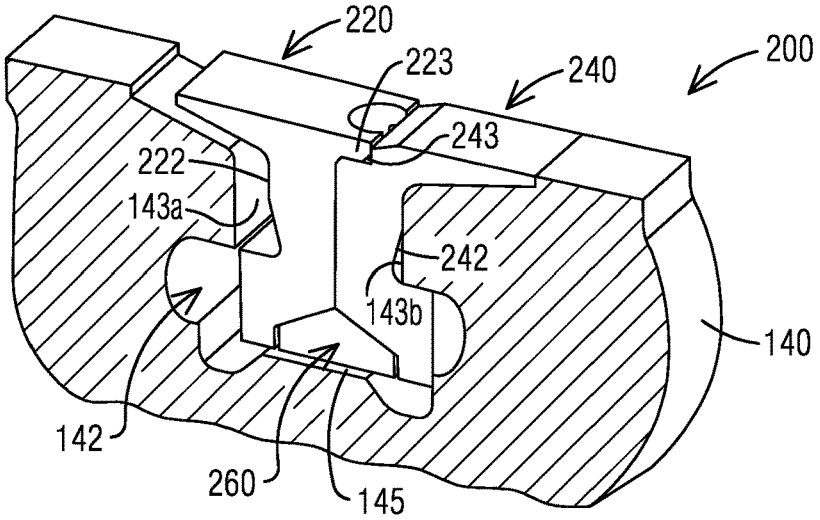

With reference to FIG. 7, the first side piece 220 having the tab 223 may then be placed into the disk groove 142 between the mid piece 260 and the first side inner surface 143*a* of the disk groove 142. The first side piece 220 may be placed next to the second side piece 240 by overlapping the tab 223 of the first side piece 220 with the recess 243 of the second side piece 240 while placing the first side piece 220 into the disk groove 142 for an easy placement.

Figure 8:
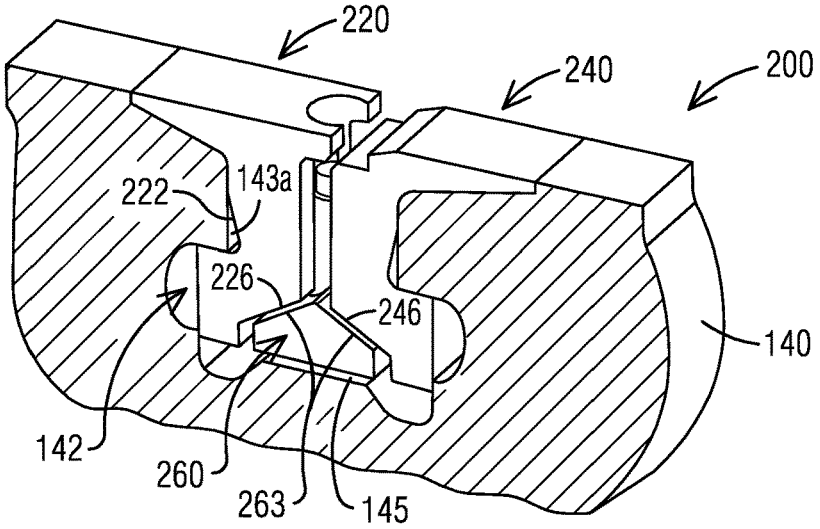

With reference to FIG. 8, the first side piece 220 may then be moved axially apart from the second side piece 240 toward the first side inner surface 143*a* such that the outer surface 222 of the first side piece 220 contacts the first side inner surface 143*a* of the disk groove 142. The mid piece 260 may then be moved in an axial direction such that the mid piece 260 aligns with the first side piece 220 and the second side piece 240. The mid piece 260 may be placed in a center of the disk groove 142 to align with the first side piece 220 and the second side piece 240.

Figure 9:
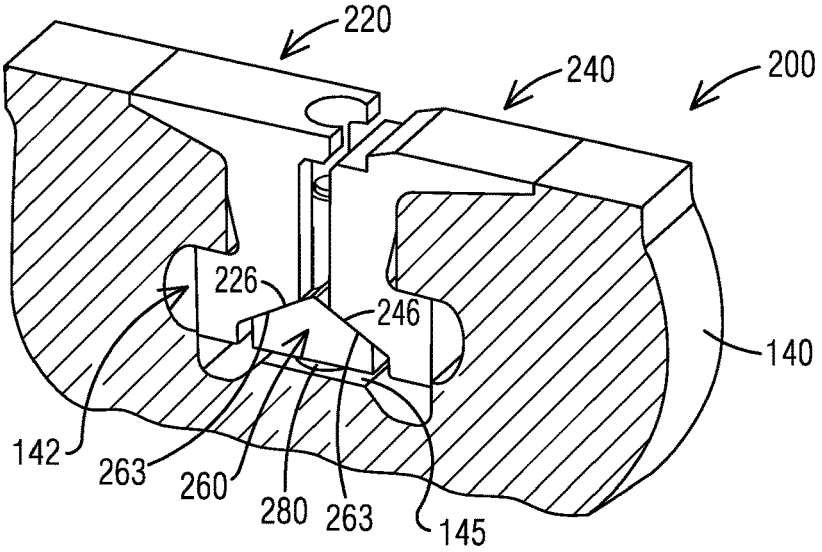

With reference to FIG. 9, the mid piece 260 is then positioned in the radial position in the assembled state by the bolt 280 such that the mid piece 260 contacts the first side piece 220 and the second side piece 240 in the assembled state. According to an exemplary embodiment shown in FIG. 9, the mid piece 260 may be lifted from the base surface 145 of the disk groove 142 to the radial position by rotating the bolt 280 radially downwardly. The top surfaces 263 of the base 262 of the mid piece 260 interlock with the bottom surface 226 of the first side piece 220 and the bottom surface 246 of the second side piece 240 respectively in the radial position. The mid piece 260 prevents axial movements of the first side piece 220 and the second side piece 240 by interlocking interfaces between the mid piece 260 and the first side piece 220 and between the mid piece 260 and the second side piece 240 in the assembled state. The bolt 280 maintains the mid piece 260 in the radial position by engaging the threads 281 with the threaded inner surface of the hollow cylindrical body 261 of the mid piece 260 in the assembled state. The bolt 280 prevents a radial movement of the mid piece 260 by such an engagement.

According to an aspect, the proposed locking spacer assembly 200 includes a first side piece 220, a second side piece 240 and a mid piece 260 which are interlocked together in the disk groove 142 of the final spacer slot 144 by arrangement and geometric interfaces between the components. The proposed locking spacer assembly 200 reduces number of machined surfaces and presents general planar surfaces for easy machining. The proposed locking spacer assembly 200 includes a bolt 280 which is threaded into the mid piece 260 to position and maintain a radial position of the mid piece 260. The proposed locking spacer assembly 200 eliminates centrifugal loads exerted to the bolt 280 during engine operation. The proposed locking spacer assembly 200 significantly reduces component stress and failures and significantly increases component safety margin during engine operation.

Although various embodiments that incorporate the teachings of the present invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

REFERENCE LIST

100: Blade Assembly
120: Blade
122: Platform of Blade
124: Root of Blade
140: Rotor Disk
142: Disk Groove
143*a*: First Side Inner Surface of Disk Groove
143*b*: Second Side Inner Surface of Disk Groove
144: Final Spacer Slot
145: Base Surface of Disk Groove
146: Circumferential Width of Final Spacer Slot
148: Axial Length of Final Spacer Slot
200: Locking Spacer Assembly
206: Circumferential Width of Locking Spacer Assembly
208: Axial Length of Locking Spacer Assembly
220: First Side Piece
221: Top Surface of the First Side Piece
222: Outer Surface of the First Side Piece
223: Tab of the First Side Piece
223*a*: Axial End of Tab
224: Cutout of Tab of First Side Piece
225: Circular Groove of First Side Piece
226: Bottom Surface of First Side Piece
227: Inner Surface of First Side Piece
240: Second Side Piece
241: Top Surface of the Second Side Piece
242: Outer Surface of the Second Side Piece
243: Recess of the Second Side Piece
243*a*: Horizontal Surface of Recess
243*b*: Vertical Surface of Recess
244: Slope Surface of Second Side Piece
245: Circular Groove of Second Side Piece
246: Bottom Surface of Second Side Piece
247: Inner Surface of Second Side Piece
260: Mid Piece
261: Hollow Cylindrical Body of Mid Piece
262: Base of Mid Piece
263: Top Surface of Base of Mid Piece
280: Bolt
281: Threads of Bolt
282: Recess of Bolt

What is claimed is:

1. A locking spacer assembly configured to fill a final spacer slot in a disk groove between platforms of adjacent blades of a blade assembly comprising:
a first side piece;
a second side piece;
a mid piece configured to be disposed between an inner surface of the first side piece and an inner surface of the second side piece; and
a bolt configured to be disposed into the mid piece,
wherein the bolt is configured to position the mid piece in a radial position in an assembled state,
wherein the mid piece is configured to contact the first side piece and the second side piece in the assembled state to prevent an axial movement of the first side piece and an axial movement of the second side piece,
wherein the mid piece comprises a base and a hollow cylindrical body,
wherein the hollow cylindrical body radially penetrates through the base and radially extends upwardly from the base, and
wherein the bolt is threaded within the hollow cylindrical body.

2. The locking spacer assembly as claimed in claim 1,
wherein the base comprises two top surfaces axially extending out from a lower end of the hollow cylindrical body, and
wherein the two top surfaces contact a bottom surface of the first side piece and a bottom surface of the second side piece in the assembled state.

3. The locking spacer assembly as claimed in claim 1,
wherein the first side piece comprises a circular groove extending radially downwardly in an inner surface,
wherein the second side piece comprises a circular groove extending radially downwardly in an inner surface, and
wherein the hollow cylindrical body of the mid piece is disposed into the circular groove of the first side piece and the circular groove of the second side piece in the assembled state.

4. The locking spacer assembly as claimed in claim 1, wherein the base comprises a dovetail shape.

5. The locking spacer assembly as claimed in claim 1, wherein the first side piece comprises a tab extending from a top surface and protruding axially outwardly from the inner surface.

6. The locking spacer assembly as claimed in claim 5, wherein the tab comprises a cutout.

7. The locking spacer assembly as claimed in claim 1, wherein the second side piece comprises a recess formed at an edge of a top surface and the inner surface.

8. A blade assembly comprising:

a rotor disk comprising a disk groove;

a plurality of blades inserted in the disk groove, wherein each of the blades comprises a platform, and wherein a final spacer slot is formed in the disk groove between platforms of adjacent blades; and a locking spacer assembly configured to fill the final spacer slot, wherein the locking spacer assembly comprises:

a first side piece;

a second side piece;

a mid piece configured to be disposed between an inner surface of the first side piece and an inner surface of the second side piece; and a bolt configured to be disposed into the mid piece, wherein the bolt is configured to position the mid piece in a radial position in an assembled state, wherein the mid piece is configured to contact the first side piece and the second side piece in the assembled state to prevent an axial movement of the first side piece and an axial movement of the second side piece, wherein the mid piece comprises a base and a hollow cylindrical body, wherein the hollow cylindrical body radially penetrates through the base and radially extends upwardly from the base, and wherein the bolt is threaded within the hollow cylindrical body.

9. The blade assembly as claimed in claim 8, wherein the base comprises two top surfaces axially extending out from a lower end of the hollow cylindrical body, and wherein the two top surfaces contact a bottom surface of the first side piece and a bottom surface of the second side piece in the assembled state.

10. The blade assembly as claimed in claim 8, wherein the first side piece comprises a circular groove extending radially downwardly in the inner surface, wherein the second side piece comprises a circular groove extending radially downwardly in the inner surface, and wherein the hollow cylindrical body of the mid piece is disposed into the circular groove of the first side piece and the circular groove of the second side piece in the assembled state.

11. The blade assembly as claimed in claim 8, wherein the base comprises a dovetail shape.

12. The blade assembly as claimed in claim 8, wherein the first side piece comprises a tab extending from a top surface and protruding axially outwardly from the inner surface.

13. The blade assembly as claimed in claim 12, wherein the tab comprises a cutout.

14. The blade assembly as claimed in claim 8, wherein the second side piece comprises a recess formed at an edge of a top surface and the inner surface.

15. A method for installing a locking spacer assembly into a final spacer slot in a disk groove between platforms of adjacent blades of a blade assembly, wherein the locking spacer assembly comprises a first side piece, a second side piece, a mid piece and a bolt, the method comprising:

disposing the bolt into the mid piece;

placing the mid piece and the bolt disposed within the mid piece into the disk groove;

placing the first side piece and the second side piece into the disk groove one after another such that the mid piece is disposed between an inner surface of the first side piece and an inner surface of the second side piece; and positioning the mid piece in a radial position in an assembled state by the bolt such that the mid piece contacts the first side piece and the second side piece in the assembled state, wherein the second side piece comprises a recess formed at an edge of a top surface and the inner surface, and wherein the first side piece and the second side piece are placed into the disk groove by overlapping the tab with the recess.

16. The method as claimed in claim 15, further comprising axially moving the mid piece in the disk groove for aligning the mid piece with the first side piece and the second side piece prior to positioning the mid piece in the radial position.

17. The method as claimed in claim 15, wherein the first side piece comprises a tab extending from a top surface and protruding axially outwardly from the inner surface.

* * * * *